US010511109B2

(12) United States Patent
Masaki et al.

(10) Patent No.: US 10,511,109 B2
(45) Date of Patent: Dec. 17, 2019

(54) SOCKET WITH LOCKING PARTS TO SECURE TO A RAIL

(71) Applicant: OMRON Corporation, Kyoto (JP)

(72) Inventors: Kenichiro Masaki, Kyoto (JP); Keisuke Yano, Kyoto (JP); Shinya Matsuo, Kyoto (JP); Tomokazu Ikeda, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/275,347

(22) Filed: Feb. 14, 2019

(65) Prior Publication Data

US 2019/0288414 A1 Sep. 19, 2019

(30) Foreign Application Priority Data

Mar. 14, 2018 (JP) ..... 2018-047106

(51) Int. Cl.
*H01R 9/26* (2006.01)
*H01R 25/14* (2006.01)
*H01R 25/16* (2006.01)

(52) U.S. Cl.
CPC ..... *H01R 9/2608* (2013.01); *H01R 9/26* (2013.01); *H01R 9/2675* (2013.01); *H01R 25/14* (2013.01); *H01R 25/142* (2013.01); *H01R 25/145* (2013.01); *H01R 25/162* (2013.01)

(58) Field of Classification Search
CPC .... H01R 25/14; H01R 9/2608; H01R 25/142; H01R 25/145; H01R 9/2675; H01R 25/162; H01R 9/26
USPC ..... 439/121, 110, 716, 532, 94
See application file for complete search history.

(56) References Cited

U.S. PATENT DOCUMENTS 4,269,471 A * 5/1981 Woertz ..... H01R 9/2691 439/716
5,615,079 A * 3/1997 Eggert ..... H01R 9/2675 361/601
5,842,889 A 12/1998 Kollmann

FOREIGN PATENT DOCUMENTS

| | | |
|---|---|---|
| DE | 2752259 | 5/1979 |
| DE | 3512143 | 7/1986 |
| EP | 0465883 | 1/1992 |
| EP | 0554519 | 8/1993 |
| GB | 2381132 | 4/2003 |

(Continued)

OTHER PUBLICATIONS

"Search Report of Europe Counterpart Application", dated Jul. 25, 2019, pp. 1-7.

*Primary Examiner* — Abdullah A Riyami
*Assistant Examiner* — Justin M Kratt
(74) *Attorney, Agent, or Firm* — JCIPRNET

(57) ABSTRACT

The disclosure provides a socket that can be held at any position on rails having different width dimensions. The socket includes a housing, which can be held on a rail that has a first side part and a second side part and extends in a first direction. The housing includes a first locking part disposed on one side of the rail in a second direction to be capable of locking the first side part in a third direction; a second locking part disposed on the other side of the rail in the second direction to be capable of locking the second side part in the third direction; and a third locking part disposed between the first locking part and the second locking part in the second direction to face the first locking part to be capable of locking the first side part of the rail in the third direction.

2 Claims, 3 Drawing Sheets

(56) References Cited

FOREIGN PATENT DOCUMENTS

| | | |
|---|---|---|
| JP | 2014150014 | 8/2014 |

* cited by examiner

SOCKET WITH LOCKING PARTS TO SECURE TO A RAIL

CROSS-REFERENCE TO RELATED APPLICATION

This application claims priority benefits of Japan Patent Application No. 2018-047106 filed on Mar. 14, 2018. The entirety of each of the above-mentioned patent applications is hereby incorporated by reference herein and made a part of this specification.

BACKGROUND

Technical Field

The disclosure relates to a socket.

Description of Related Art

Patent Document 1 discloses a relay terminal block that can be held on a DIN rail standardized to Deutsches Institut für Normung e.V. (DIN). The relay terminal block includes a substantially rectangular parallelepiped block, which has a plurality of terminal parts constituted by terminal plates, washers, and screws. The lower surface of the block has a stepped portion that is formed with a decreasing dimension in the height direction. A fixed hook and a movable hook, which are opposite to each other and protrude in a direction to be close to each other, are disposed on two sides of the stepped portion in the longitudinal direction of the block. The block of the terminal block is held on the DIN rail by the fixed hook and the movable hook.

RELATED ART

Patent Document

[Patent Document 1] Japanese Laid-open No. 2014-150014

Regarding the terminal block, the block is configured so that it can be held at any position with respect to the DIN rail. However, for a rail that has a width dimension different from the DIN rail (for example, a rail having a width dimension smaller than that of the DIN rail), the terminal block has to use another holding means, and it may not be possible to hold the block at any position.

The disclosure provides a socket that can be held at any position on rails having different width dimensions.

SUMMARY

A socket according to an example of the disclosure includes:

a housing configured to be held on a rail, which extends straight in a first direction and includes a first side part and a second side part facing each other in a second direction that intersects the first direction, wherein the housing includes:

a first locking part disposed on one side of the rail in the second direction to be in contact with the first side part of the rail and capable of locking the first side part in a third direction that intersects the first direction and the second direction;

a second locking part disposed on the other side of the rail in the second direction to be in contact with the second side part of the rail and capable of locking the second side part in the third direction; and a third locking part disposed between the first locking part and the second locking part in the second direction to face the first locking part to be in contact with the first side part of the rail and capable of locking the first side part of the rail in the third direction.

DESCRIPTION OF THE EMBODIMENTS

Hereinafter, an example of the disclosure will be described with reference to the accompanying drawings. In the following description, terms (for example, terms including "upper", "lower", "right", and "left") that indicate specific directions or positions are used as necessary. However, these terms are used to facilitate understanding of the disclosure with reference to the drawings, and the technical scope of the disclosure is not limited by the meanings of these terms. In addition, the following description is merely exemplary and is not intended to limit the disclosure, its application, or its usage. Furthermore, the drawings are schematic, and the ratio of the dimensions does not necessarily agree with the actual one.

Figure 1:
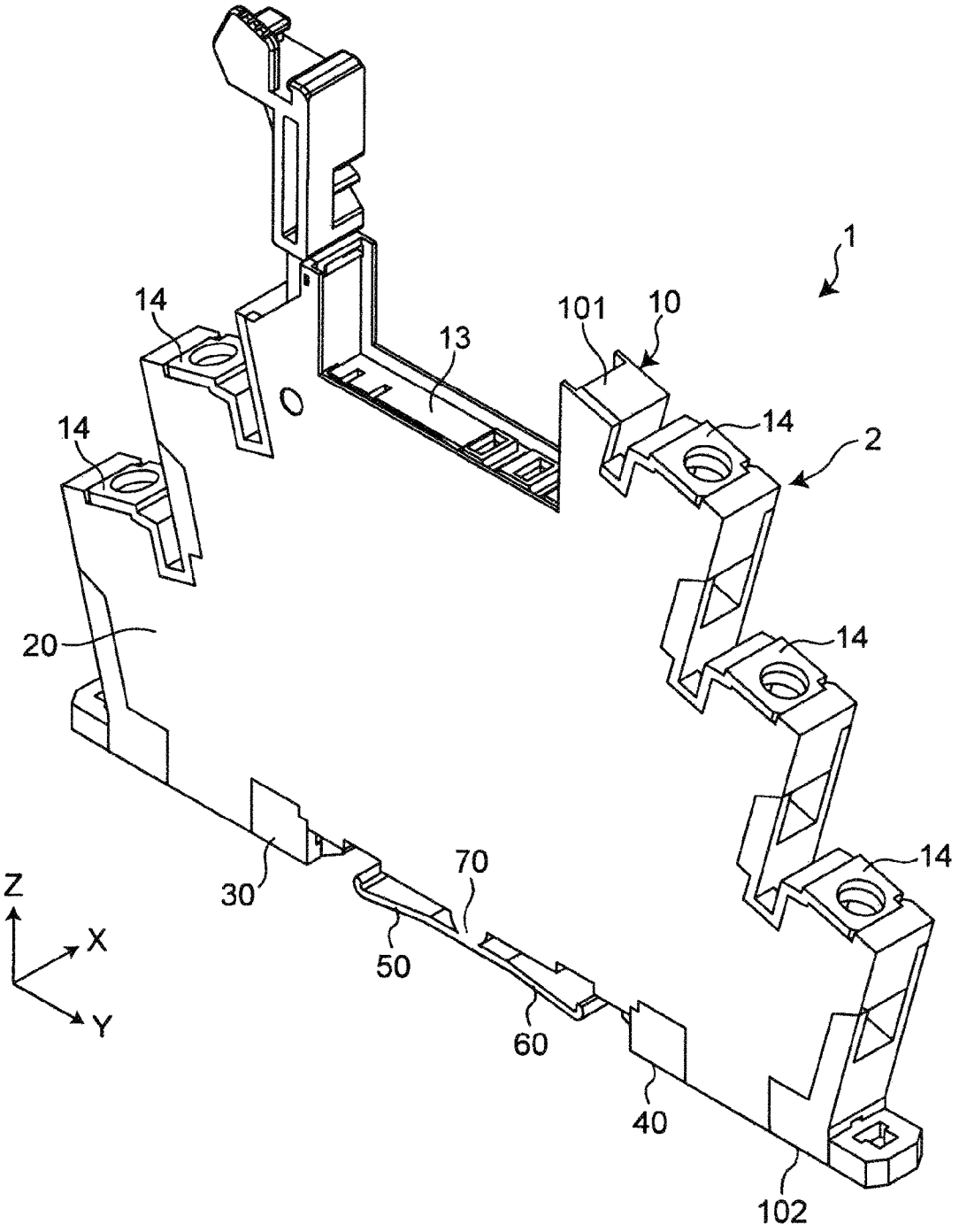
FIG. 1 is a perspective view showing a socket according to an embodiment of the disclosure.
Figure 2:
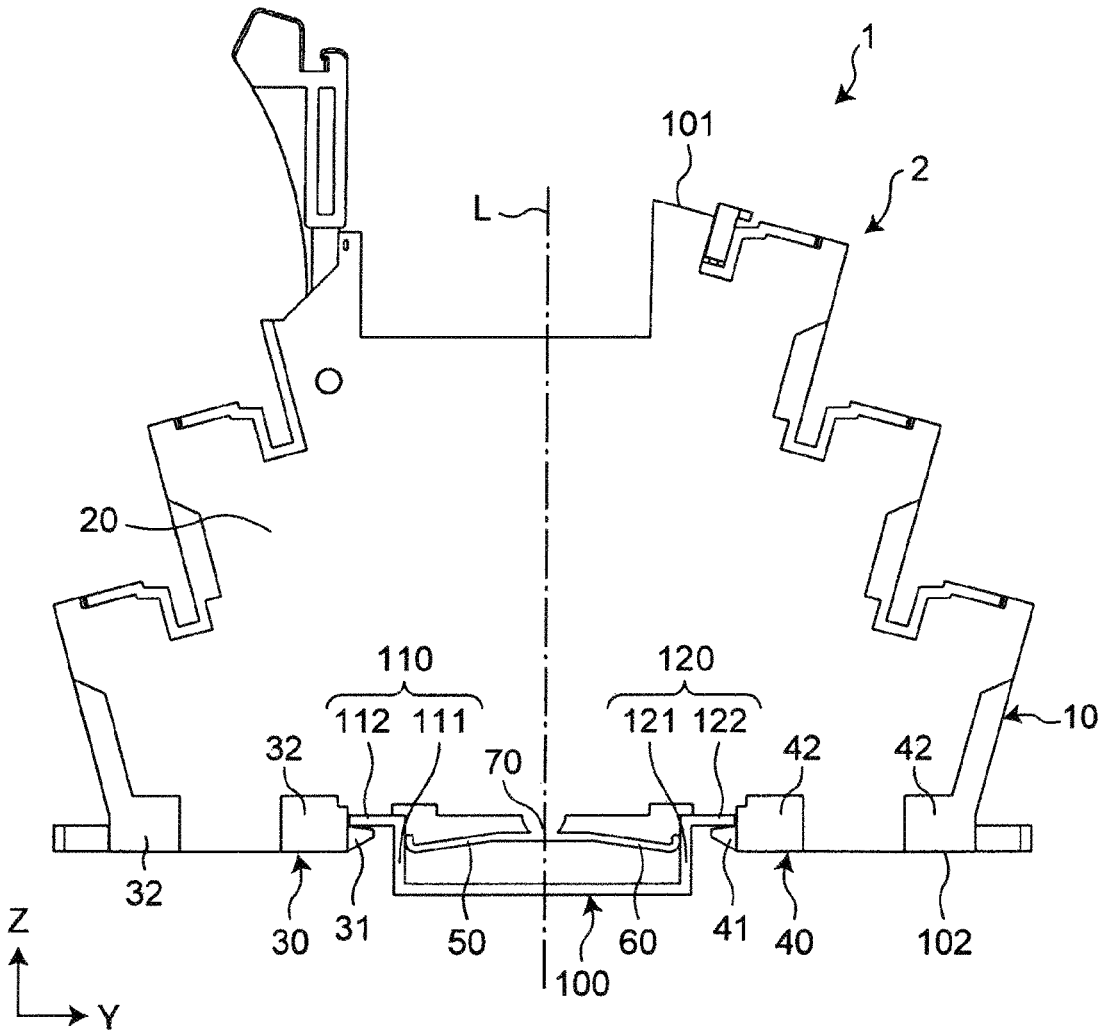
FIG. 2 is a plan view of the socket of FIG. 1.

As shown in FIG. 1, a socket 1 of an embodiment of the disclosure includes an elongated box-shaped housing 2. As shown in FIG. 2, the housing 2 is configured to be held on a rail 100, which extends straight in a first direction X (as shown in FIG. 1, a direction passing through the paper surface of FIG. 2) and has a first side part 110 and a second side part 120. The first side part 110 and the second side part 120 face each other in a second direction (in other words, the width direction) Y that intersects (for example, is orthogonal to) the first direction.

The rail 100 is a DIN rail standardized to Deutsches Institut für Normung e.V. (DIN), for example, and has a substantially U shape as viewed in the first direction X. Each of the first side part 110 and the second side part 120 includes a side wall part 111, 121 and a flange part 112, 122. The side wall part 111, 121 extends along a third direction Z that intersects (for example, is orthogonal to) the first direction X and the second direction Y. The flange part 112, 122 is disposed at one end portion (that is, the upper end portion of FIG. 2) of the side wall part 111, 121. In addition, the flange parts 112 and 122 extend in opposite directions along the second direction X.

As shown in FIG. 1, the housing 2 includes an elongated box-shaped base 10 and a casing 20 attached to the base 10. The base 10 has a first side 101 and a second side 102 that are opposite to each other in the third direction Z. Each of the first side 101 and the second side 102 has a substantially rectangular shape as viewed in the third direction Z.

A device connection part 13, which can connect an electronic device such as an electromagnetic relay, is disposed at substantially the center of the first side 101 in the longitudinal direction thereof. In addition, wire connection parts 14, which can connect wires respectively, are disposed on two sides of the device connection part 13 in the second direction Y. As an example, a plurality of wire connection parts 14 are disposed and arranged side by side in a line at equal intervals along the second direction Y.

Two wire connection parts 14 are disposed on one side of the device connection part 13 in the second direction Y and three wire connection parts 14 are disposed on the other side of the device connection part 13 in the second direction Y. A first terminal connection part (not shown) that can connect a terminal of an electromagnetic relay, for example, is disposed in the device connection part 13. A second terminal connection part (not shown) that can connect a conductor part of a wire is disposed in each wire connection part 14. The first terminal connection part and the second terminal connection part are electrically connected inside the housing 2.

As shown in FIG. 2, a first locking part 30 and a second locking part 40 are respectively disposed at two end portions of the second side 102 of the base 10 in the second direction Y. Further, a third locking part 50 and a fourth locking part 60 are disposed between the first locking part 30 and the second locking part 40 in the second direction Y. The third locking part 50 and the fourth locking part 60 are respectively connected to a protruding part 70 disposed midway between the first locking part 30 and the second locking part 40 in the second direction Y, and are connected to the base 10 via the protruding part 70.

The first locking part 30 includes a rail-shaped contact part 31 to be in contact with the first side part 110 of the rail 100, and a fixing part 32 that is integrally formed on the base 10 for fixing the contact part 31. In addition, the second locking part 40 includes a rail-shaped contact part 41 to be in contact with the second side part 120 of the rail 100, and a fixing part 42 that is integrally formed on the base 10 for fixing the contact part 41.

As shown in FIG. 2, the contact part 31, 41 of each of the first locking part 30 and the second locking part 40 extends in the second direction Y and is configured to be in contact with the flange part 112, 122 of each side part 110, 120 of the rail 100 to be locked to the side part 110, 120 in the third direction Z.

Specifically, the contact parts 31 and 41 of the locking parts 30 and 40 are disposed so that their surfaces which face the base 10 in the third direction Z are positioned on the same straight line extending in the second direction Y. Gaps are formed respectively between the contact parts 31 and 41 of the locking parts 30 and 40 and the base 10 for positioning the flange parts 112 and 122 of the side parts 110 and 120 of the rail 100. In the gaps, the contact parts 31 and 41 of the locking parts 30 and 40 are respectively locked with the flange parts 112 and 122 of the side parts 110 and 120 of the rail 100.

Furthermore, one or both of the contact parts 31 and 41 of the locking parts 30 and 40 are configured to be movable in the second direction Y with respect to the fixing part 32. That is, the contact parts 31 and 41 of the locking parts 30 and 40 are configured to be movable between a locking position and a non-locking position. The locking position is where the contact parts 31 and 41 are locked with the flange parts 112 and 122 of the side parts 110 and 120 of the rail 100, and the non-locking position is where the contact parts 31 and 41 are not locked with the flange parts 112 and 122 of the side parts 110 and 120 of the rail 100.

The individual fixing parts 32 and 42 of the first locking part 30 and the second locking part 40 are disposed to be two (i.e., the fixing parts 32, 32 and the fixing parts 42, 42) with a gap therebetween in the second direction Y (that is, the extending direction of the contact parts 31 and 41), and it is possible to reliably fix the contact parts 31 and 41 with only the fixing parts 32 and 42. The gap between the two fixing parts 32 and 42 is covered with the casing 20. Therefore, by removing the casing 20, it is possible to visually recognize the shapes of the first locking part 30 and the second locking part 40 from the outside. That is, the precision of the base 10 can be easily confirmed.

Figure 3:
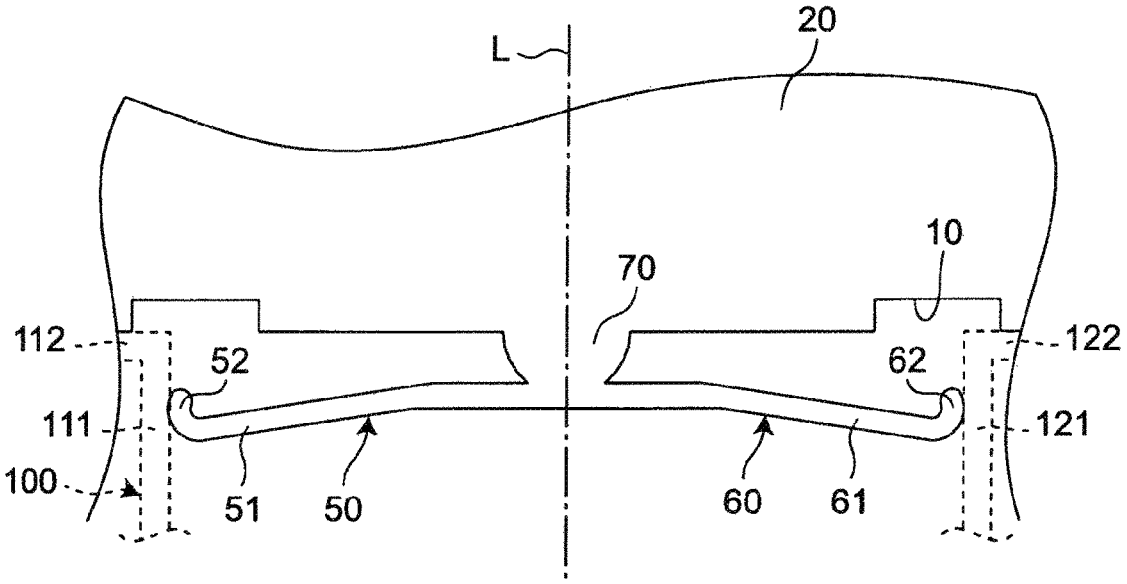
FIG. 3 is an enlarged plan view of a third locking part and a fourth locking part of the socket of FIG. 1.

As shown in FIG. 2, the third locking part 50 is disposed between the first locking part 30 and the second locking part 40 in the second direction Y to face the first locking part 30. Specifically, as shown in FIG. 3, the third locking part 50 has a first plate spring part 51 that extends from the protruding part 70 toward the first locking part 30 along the second direction Y, and a tip part 52 close to the first locking part 30 in the extending direction of the first plate spring part 51 is bent toward the base 10.

The first plate spring part 51 is elastically deformable in a direction away from the first locking part 30 and the bent tip part 52 of the first plate spring part 51 is arranged to be in contact with the side wall part 111 of the first side part 110 of the rail 100. That is, the first plate spring part 51 of the third locking part 50 elastically contacts the first side part 110 of the rail 100 from a direction opposite to the first locking part 30 with respect to the first side part 110, and is configured to lock the first side part 110 of the rail 100 in the third direction Z.

As shown in FIG. 2, the fourth locking part 60 is disposed between the first locking part 30 and the second locking part 40 in the second direction Y to face the second locking part 40. Specifically, as shown in FIG. 3, the fourth locking part 60 has a second plate spring part 61 that extends from the protruding part 70 toward the second locking part 40 along the second direction Y, and a tip part 62 close to the second locking part 40 in the extending direction of the second plate spring part 61 is bent toward the base 10.

The second plate spring part 61 is elastically deformable in a direction away from the second locking part 40 and the bent tip part 62 of the second plate spring part 61 is arranged to be in contact with the side wall part 121 of the second side part 120 of the rail 100. That is, the second plate spring part 61 of the fourth locking part 60 elastically contacts the second side part 120 of the rail 100 from a direction opposite to the second locking part 40 with respect to the second side part 120, and is configured to lock the second side part 120 of the rail 100 in the third direction Z.

As shown in FIG. 2, the first plate spring part 51 and the second plate spring part 61 are respectively arranged so that the tip parts 52 and 62 are farther away from the base 10 than the first contact part 31 and the second contact part 41 in the third direction Z. Thus, the third locking part 50 and the fourth locking part 60 can more reliably lock the side wall parts 111 and 121 of the side parts 110 and 120 of the rail 100 in the third direction Z.

Further, as shown in FIG. 2, the protruding part 70 is disposed at the center of the first locking part 30 and the second locking part 40 in the second direction Y. The third locking part 50, the fourth locking part 60, and the protruding part 70 are integrally formed on the base 10. The third locking part 50, the fourth locking part 60, and the protruding part 70 are disposed symmetrically with respect to a virtual straight line L, which passes through the center of the first locking part 30 and the second locking part 40 in the second direction Y and extends in the third direction Z that intersects (for example, is orthogonal to) the first direction X and the second direction Y.

The socket 1 is held on the rail 100 and released from the rail 100 as described below.

When the socket 1 is to be held on the rail 100, first, at least one of the first locking part 30 and the second locking part 40 is moved to the non-locking position, and then the socket 1 is moved in the third direction Z and attached to the rail 100.

At this time, as shown in FIG. 3, the third locking part 50 and the fourth locking part 60 slide smoothly in the third direction Z in a state where the tip part 52 of the third locking part 50 and the tip part 62 of the fourth locking part 60 respectively come into contact with the opposite inner surfaces of the side wall parts 111 and 121 of the side parts 110 and 120, and the first plate spring part 51 and the second plate spring part 61 are elastically deformed in the second direction Y and in a direction to be close to each other.

After the socket 1 is attached to the rail 100, the at least one of the first locking part 30 and the second locking part 40, which has been moved, is moved from the non-locking position to the locking position. As a result, the contact part 31 of the first locking part 30 is locked to the flange part 112 of the first side part 110 of the rail 100 in the third direction Z, and the contact part 41 of the second locking part 40 is locked to the flange part 122 of the second side part 120 of the rail 100 in the third direction Z. Moreover, the third locking part 50 is locked to the side wall part 111 of the first side part 110 of the rail 100 in the third direction Y by the elastic force of the first plate spring part 51, and the fourth locking part 60 is locked to the side wall part 121 of the second side part 120 of the rail 100 in the third direction Y by the elastic force of the second plate spring part 61. That is, with the first locking part 30, the second locking part 40, the third locking part 50, and the fourth locking part 60, the socket 1 is locked and held on the rail 100 in the third direction Z.

In addition, when the socket 1 is to be released from the rail 100, at least one of the first locking part 30 and the second locking part 40, which has been moved to the locking position, is moved from the locking position to the non-locking position, and then the socket 1 is moved along the third direction Z and removed from the rail 100.

In the socket 1, the housing 2 includes the first locking part 30 disposed on one side of the rail 100 in the second direction Y to be capable of locking the first side part 110 of the rail 100 in the third direction Z; the second locking part 30 disposed on the other side of the rail 100 in the second direction Y to be capable of locking the second side part 120 of the rail 100 in the third direction Z; and the third locking part 50 disposed between the first locking part 30 and the second locking part 40 in the second direction Y to face the first locking part 30 to be capable of locking the first side part 110 of the rail 100. Thus, for example, even if the rail 100 has a small width dimension and the first locking part 30 cannot lock the first side part 110 of the rail 100, the housing 2 can still be held at any position on the rail 100 by the second locking part 40 and the third locking part 50. As a result, it is possible to realize the socket 1 that can be held at any position on rails having different width dimensions.

The housing 2 further includes the fourth locking part 40, which is disposed between the second locking part 40 and the third locking part 50 in the second direction Y to face the second locking part 40 to be capable of locking the second side part 120 of the rail 100 in the third direction Z. That is, since the housing 2 further includes the fourth locking part 60 in addition to the first to third locking parts 30, 40, and 50, the housing 2 can be held more reliably at any position on the rail 100.

In addition, the third locking part 50 and the fourth locking part 60 are arranged symmetrically with respect to the virtual straight line L that passes through the center of the first locking part 30 and the second locking part 40 in the second direction Y and extends in the third direction Z. Since the third locking part 50 and the fourth locking part 60 can lock the corresponding side parts 110 and 120 of the rail 100 in a balanced manner, the housing 2 can be held more reliably at any position on the rail 100.

The housing 2 further includes the protruding part 70 that is disposed midway between the first locking part 30 and the second locking part 40, and the third locking part 50 and the fourth locking part 60 are connected to the protruding part 70. With the protruding part 70, each of the third locking part 50 and the fourth locking part 60 can be easily arranged between the first locking part 30 and the second locking part 40.

Moreover, the third locking part 50 includes the first plate spring part 51 that extends from the protruding part 70 toward the first locking part 30, and the tip part 52 close to the first locking part 30 in the extending direction of the first plate spring part is bent. The fourth locking part 60 includes the second plate spring part 61 that extends from the protruding part 70 toward the second locking part 40, and the tip part 62 close to the second locking part 40 in the extending direction of the second plate spring part 61 is bent. Thus, the housing 2 can be held at any position on the rail 100 with a simple configuration.

Since the plate spring parts 51 and 61 have the bent tip parts 52 and 62 respectively, the socket 1 can be attached to and removed from the rail 100 smoothly.

Furthermore, the third locking part 50, the fourth locking part 60, and the protruding part 70 are integrally formed. Thus, the number of parts of the socket 1 can be reduced and the manufacturing cost of the socket 1 can be reduced.

Nevertheless, the socket 1 does not necessarily include the first to fourth locking parts 30, 40, 50, and 60. The disclosure can be applied to a socket, which includes at least one locking part in addition to the first locking part 30 and the second locking part 40, wherein the at least one locking part is disposed between the first locking part 30 and the second locking part 40 to be capable of locking the rail 100 in the third direction Z.

For example, the third locking part 50 and the fourth locking part 60 may not be arranged symmetrically with respect to the virtual straight line L. Besides, one of the third locking part 50 and the fourth locking part 60 may be omitted, or the protruding part 70 may be omitted and the third locking part 50 and the fourth locking part 60 may be directly connected to the base 10. Further, the third locking part 50, the fourth locking part 60, and the protruding part 70 may be provided separately.

In addition, the first to fourth locking parts 30, 40, 50, and 60 may have any configuration as long as they can lock the corresponding side parts 110 and 120 of the rail 100 in the third direction.

Figure 4:
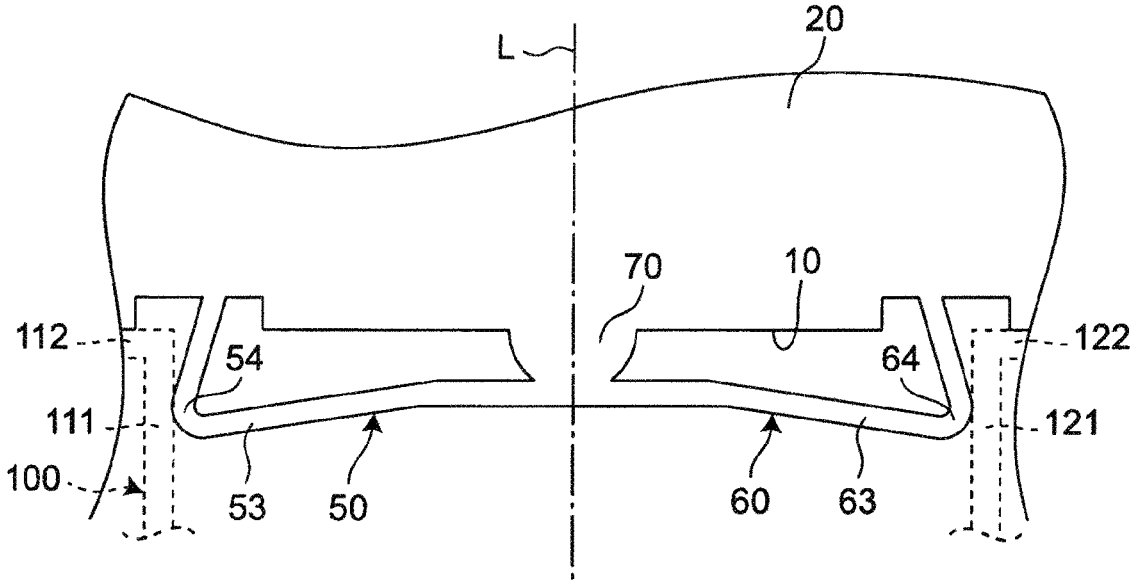
FIG. 4 is an enlarged plan view showing a modified example of the third locking part and the fourth locking part of the socket of FIG. 1.

For example, as shown in FIG. 4, the third locking part 50 and the fourth locking part 60 may include plate spring parts 53 and 63 respectively. Two end portions of each of the plate spring parts 53 and 63 are connected to the base 10 and the protruding part 70 respectively, and the plate spring parts 53 and 63 have bent parts 54 and 64 in the middle. In that case, the protruding part 70 may be omitted. However, the protruding part 70 can reinforce the third locking part 50 and the fourth locking part 60.

The socket 1 can be applied not only to the rail 100 that has the flange parts 112 and 122 but also to a rail 100 that does not have the flange parts 112 and 122. In the latter case, for example, the socket 1 may be configured to hold the side wall part 111 of the first side part 110 with the first contact part 31 of the first locking part 30 and the plate spring part 51 of the third locking part 50 so as to lock the first side part 110 in the third direction Z.

Although various embodiments of the disclosure have been described in detail above with reference to the drawings, finally various aspects of the disclosure will be described. The following description is provided with reference numerals as an example.

A socket 1 according to the first aspect of the disclosure includes:

a housing 2 configured to be held on a rail 100, which extends straight in a first direction X and includes a first side part 110 and a second side part 120 facing each other in a second direction Y that intersects the first direction X, wherein the housing 2 includes:

a first locking part 30 disposed on one side of the rail 100 in the second direction Y to be capable of locking the first side part 110 in a third direction Z that intersects the first direction X and the second direction Y;

a second locking part 40 disposed on the other side of the rail 100 in the second direction Y to be capable of locking the second side part 120 in the third direction Z; and a third locking part 50 disposed between the first locking part 30 and the second locking part 40 in the second direction Y to face the first locking part 30 to be capable of locking the first side part 110 of the rail 100 in the third direction Z.

According to the socket 1 of the first aspect, for example, even if the rail 100 has a small width dimension and the first locking part 30 cannot lock the first side part 110 of the rail 100, the housing 2 can still be held at any position on the rail 100 by the second locking part 40 and the third locking part 50. As a result, it is possible to realize the socket 1 that can be held at any position on rails having different width dimensions.

In the socket 1 according to the second aspect of the disclosure, the housing 2 further includes a fourth locking part 60 disposed between the second locking part 40 and the third locking part 50 in the second direction Y to face the second locking part 40 to be capable of locking the second side part 120 of the rail 100 in the third direction Z.

According to the socket 1 of the second aspect, since the housing 2 further includes the fourth locking part 60 in addition to the first to third locking parts 30, 40, and 50, the housing 2 can be held more reliably at any position on the rail 100.

In the socket 1 according to the third aspect of the disclosure, the third locking part 50 and the fourth locking part 60 are arranged symmetrically with respect to a virtual straight line L that passes through a center of the first locking part 30 and the second locking part 40 in the second direction Y and extends in the third direction Z.

According to the socket 1 of the third aspect, since the third locking part 50 and the fourth locking part 60 can lock the corresponding side parts 110 and 120 of the rail 100 in a balanced manner, the housing 2 can be held more reliably at any position on the rail 100.

In the socket 1 according to the fourth aspect of the disclosure, the housing 2 further includes a protruding part 70 disposed midway between the first locking part 30 and the second locking part 40, and the third locking part 30 and the fourth locking part 60 are connected to the protruding part 70.

According to the socket 1 of the fourth aspect, with the protruding part 70, each of the third locking part 50 and the fourth locking part 60 can be easily disposed between the first locking part 30 and the second locking part 40.

In the socket 1 according to the fifth aspect of the disclosure, the third locking part 50 includes a first plate spring part 51 extending from the protruding part 70 toward the first locking part 30, wherein a tip part 52 close to the first locking part 30 in an extending direction of the first plate spring part 51 is bent. The fourth locking part 60 includes a second plate spring part 61 extending from the protruding part 70 toward the second locking part 30, wherein a tip part 62 close to the second locking part 40 in an extending direction of the second plate spring part 61 is bent.

According to the socket 1 of the fifth aspect, the housing 2 can be held at any position on the rail 100 with a simple configuration.

In the socket 1 according to the sixth aspect of the disclosure, the third locking part 50, the fourth locking part 60, and the protruding part 70 are integrally formed.

According to the socket 1 of the sixth aspect, the number of parts of the socket 1 can be reduced and the manufacturing cost of the socket 1 can be reduced.

Any of the various embodiments or modified examples may be combined as appropriate to achieve the respective effects. It is also possible to combine the embodiments, to combine the examples, or to combine the embodiments with the examples, and to combine features in different embodiments or examples.

According to the socket, the housing includes the first locking part disposed on one side of the rail to be capable of locking the first side part of the rail; the second locking part disposed on the other side of the rail to be capable of locking the second side part of the rail; and the third locking part disposed between the first locking part and the second locking part to face the first locking part to be capable of locking the first side part of the rail. Thus, for example, even if the rail has a small width dimension and the first locking part cannot lock the first side part of the rail, the housing can still be held at any position on the rail by the second locking part and the third locking part. As a result, it is possible to realize the socket that can be held at any position on rails having different width dimensions.

INDUSTRIAL APPLICABILITY

The socket of the disclosure can be used in a control panel, for example.

What is claimed is:

1. A socket, comprising:

a housing configured to be held on a rail, which extends straight in a first direction and comprises a first side part and a second side part facing each other in a second direction that intersects the first direction, wherein the housing comprises:

a first locking part disposed on one side of the rail in the second direction to be capable of locking the first side part in a third direction that intersects the first direction and the second direction;

a second locking part disposed on the other side of the rail in the second direction to be capable of locking the second side part in the third direction;

a third locking part disposed between the first locking part and the second locking part in the second direction to face the first locking part to be capable of locking the first side part of the rail in the third direction;

a fourth locking part disposed between the second locking part and the third locking part in the second direction to face the second locking part to be capable of locking the second side part of the rail in the third direction, wherein the third locking part and the fourth locking part are arranged symmetrically with respect to a virtual straight line that passes through a center of the first locking part and the second locking part in the second direction and extends in the third direction; and a protruding part disposed midway between the first locking part and the second locking part, and the third locking part and the fourth locking part are connected to the protruding part, wherein the third locking part comprises:

a first plate spring part extending from the protruding part toward the first locking part, wherein a tip part close to the first locking part in an extending direction of the first plate spring part is bent, and the fourth locking part comprises:

a second plate spring part extending from the protruding part toward the second locking part, wherein a tip part close to the second locking part in an extending direction of the second plate spring part is bent.

2. The socket according to claim 1, wherein the third locking part, the fourth locking part, and the protruding part are integrally formed.

* * * * *